US010418217B2

(12) United States Patent
Zhang et al.

(10) Patent No.: US 10,418,217 B2
(45) Date of Patent: Sep. 17, 2019

(54) ARC EXTINGUISHING STRUCTURE FOR DIRECT CURRENT CIRCUIT BREAKER

(71) Applicant: ZHEJIANG PEOPLE ELE. APPLIANCE CO., LTD., Zhejiang (CN)

(72) Inventors: Yanxia Zhang, Zhejiang (CN); Li Zhang, Zhejiang (CN); Zhihao Zheng, Zhejiang (CN); Qianzhong Chen, Zhejiang (CN)

(73) Assignee: ZHEJIANG PEOPLE ELE. APPLIANCE CO., LTD., Zhejiang (CN)

( * ) Notice: Subject to any disclaimer, the term of this patent is extended or adjusted under 35 U.S.C. 154(b) by 0 days.

(21) Appl. No.: 15/755,724

(22) PCT Filed: May 17, 2017

(86) PCT No.: PCT/CN2017/084652
§ 371 (c)(1),
(2) Date: Feb. 27, 2018

(87) PCT Pub. No.: WO2017/198166
PCT Pub. Date: Nov. 23, 2017

(65) Prior Publication Data

US 2018/0323028 A1 Nov. 8, 2018

(30) Foreign Application Priority Data

May 17, 2016 (CN) ..... 2016 1 0325223

(51) Int. Cl.
*H01H 9/30* (2006.01)
*H01H 9/34* (2006.01)
(Continued)

(52) U.S. Cl.
CPC ..... *H01H 73/18* (2013.01); *H01H 9/302* (2013.01); *H01H 9/346* (2013.01); *H01H 71/10* (2013.01); *H01H 73/06* (2013.01); *H01H 9/345* (2013.01)

(58) Field of Classification Search
CPC ..... H01H 9/302; H01H 9/34; H01H 9/346; H01H 71/10; H01H 73/06; H01H 73/18
(Continued)

(56) References Cited

U.S. PATENT DOCUMENTS 6,248,970 B1 * 6/2001 DiMarco ..... H01H 9/34 218/149
6,518,530 B2 * 2/2003 Heins ..... H01H 9/362 218/149
(Continued)

FOREIGN PATENT DOCUMENTS

CN 201285744 8/2009
CN 102623270 8/2012
(Continued)

OTHER PUBLICATIONS

Translation of CN201285744 (Y)(Original document filed Aug. 5, 2009) (Year: 2009).*
International Search Report for PCT Application No. PCT/CN2017/084652, dated Nov. 23, 2017 via WIPO Patentscope.

*Primary Examiner* — Edwin A. Leon
*Assistant Examiner* — William A Bolton
(74) *Attorney, Agent, or Firm* — Terry M. Sanks, Esq.; Beusse Wolter Sanks & Maire, PLLC

(57) ABSTRACT

The present invention provides an arc extinguishing structure for direct current circuit breaker, which comprises a first casing, a second casing, an arc extinguishing chamber, a gas generating hood, a movable contactor and a stationary contactor, with a plurality of arc extinguishing grid-plates installed at an upper part inside the arc extinguishing cham-
(Continued)

ber and having lower slots which are open towards an accommodation space and have a size that gradually decreases along a direction from the second casing to the first casing, wherein the first casing has a first extension plate disposed against the first gas generating plate and a second extension plate disposed against the second gas generating plate, the first extension plate and the second extension plate are arranged to extend into the arc extinguishing chamber so as to form a spacing communicated with the accommodation space and disposed opposite to the arc extinguishing grid-plates.

9 Claims, 7 Drawing Sheets

(51) Int. Cl.
*H01H 71/10* (2006.01)
*H01H 73/06* (2006.01)
*H01H 73/18* (2006.01)

(58) Field of Classification Search
USPC ... 218/46, 15, 34, 76, 81, 90, 105, 149, 158
See application file for complete search history.

(56) References Cited

U.S. PATENT DOCUMENTS

| | | | | |
|---|---|---|---|---|
| 7,186,941 | B2 * | 3/2007 | Yeon | H01H 9/302 218/149 |
| 7,488,915 | B2 * | 2/2009 | Pollitt | H01H 9/342 218/149 |
| 9,153,399 | B2 * | 10/2015 | Afshari | H01H 33/08 |
| 2010/0258531 | A1 * | 10/2010 | Bresciani | H01H 9/36 218/151 |
| 2013/0284702 | A1 * | 10/2013 | Hamada | H01H 9/302 218/26 |
| 2015/0348720 | A1 * | 12/2015 | Smeltzer | H01H 9/34 218/151 |

FOREIGN PATENT DOCUMENTS

| | | |
|---|---|---|
| CN | 203826321 | 9/2014 |
| CN | 104124117 | 10/2014 |
| CN | 204067289 | 12/2014 |
| CN | 105762041 | 7/2016 |
| CN | 105788986 | 7/2016 |
| CN | 205595296 | 9/2016 |
| CN | 205595297 | 9/2016 |
| JP | S62276724 | 12/1987 |

* cited by examiner

ARC EXTINGUISHING STRUCTURE FOR DIRECT CURRENT CIRCUIT BREAKER

TECHNICAL FIELD

The present invention relates to the technical field of arc extinguishing technology for direct current circuit breaker, and in particular relates to an arc extinguishing structure for direct current circuit breaker.

BACKGROUND

Low voltage circuit breaker is an important electrical equipment for electricity transmission and distribution and plays an important role in distributing electric power and protecting devices and personnel safety in electrical circuits. Under normal working conditions, a low voltage circuit breaker distributes and controls the power consumption load by connecting or disconnecting its contactors. When a malfunction occurs in the electrical circuit, the circuit breaker detects a malfunction signal and actuates a disconnector to separate the contactors, thereby disconnecting the faulty circuit line. If a short-circuit malfunction occurs in the electrical circuit, when disconnecting the short-circuit current, quick extinguishing of electric arc is an important condition to ensure reliable disconnection of the circuit breaker. In an alternating current system, because the alternating current has zero crossing points, it is relatively easy to extinguish an electric arc. However, as direct current does not have a zero crossing point, it is relatively difficult to extinguish an electric arc. As present, a popular method is to install a permanent magnet to enhance the arc extinguishing effect. Although this kind of method helps to extinguish an electric arc, it limits the wiring manner of positive and negative electrodes of the circuit breaker.

Chinese patent literature CN204067289U disclosed a direct current circuit breaker with plastic casing, which comprises a first casing and a second casing that are detachably connected, wherein, several evenly distributed arc extinguishing grid-plates are provided inside an arc extinguishing chamber, the arc extinguishing chamber has an upper end opening that faces the first casing, a gas generating bracket corresponding to the arc extinguishing grid-plates is provided inside the arc extinguishing chamber, with one end of the gas generating bracket disposed between the first casing and the upper end opening and arranged to cover the upper end opening; the gas generating bracket has two oppositely disposed gas generating arms with one end thereof provided with a shield plate, the shield plate is disposed between the first casing and the upper end opening and arranged to cover the upper end opening.

In the direct current circuit breaker with plastic casing of this patent literature, although no permanent magnet is installed to enhance the arc extinguishing effect and thus the wiring manner of positive and negative electrodes of the circuit breaker is not limited, a shield plate is added between the upper end opening of the arc extinguishing chamber and the first casing, such design may prevent the pressurized gas produced by electric arc combustion from leaking out at this location and thus protect the first casing from being impinged upon and cracking, however, there is the following problem: as seen from FIG. 6 of its Specification, the disconnecting portion between a movable contactor and a stationary contactor is near the second casing and far from the shield plate, therefore, when the movable contactor becomes disconnected from the stationary contactor and an electric arc is produced, the gas generating arm closest to the electric arc is heated and generates gas, so as to push the electric arc to move towards the shield plate; during the moving process of the electric arc towards the shield plate, because of a shielding effect of the shield plate, the gas pressure increases rapidly, which blocks the motion of the electric arc and causes the moving distance thereof to be short, and under the relatively larger gas pressure, the electric arc moves towards the arc extinguishing grid-plates when moving upwards; because the moving distance of the electric arc is short, the upward moving electric arc can only contact the part of the arc extinguishing grid-plates that are close to the disconnecting portion between the movable contactor and the stationary contactor, and is unable to fully utilize a majority of the arc extinguishing grid-plates, which causes the temperature of the part of the arc extinguishing grid-plates close to the disconnecting portion to rapidly become high, not good for quick cooling of the electric arc and thus not good for quick extinguishing of the electric arc, and if the electric arc is still not extinguished after passing through the arc extinguishing grid-plates, danger might be incurred.

SUMMARY OF THE INVENTION

Therefore, a technical problem to be solved by the present invention is how to overcome the defect in the prior art that a shield plate is added between the upper end opening of the arc extinguishing chamber and the first casing, causing the moving distance of the electric arc inside the arc extinguishing chamber to be short, which leads to that a majority of the arc extinguishing grid-plates cannot be fully utilized and thus the electric arc is difficult to be extinguished. For this purpose, the present invention provides an arc extinguishing structure for direct current circuit breaker that not only can protect the casing, but also can fully utilize a majority of arc extinguishing grid-plates for improving the arc extinguishing effect.

Thus, the present invention provides an arc extinguishing structure for direct current circuit breaker, which comprises:

a first casing;

a second casing, disposed opposite to the first casing and detachably connected to the first casing, for forming an internal installation space;

an arc extinguishing chamber, installed on the second casing and disposed inside the internal installation space, with an upper opening, a lower opening and a lateral opening which opens towards the first casing;

a gas generating hood, installed at a lower part inside the arc extinguishing chamber, comprising a first gas generating plate and a second gas generating plate that are disposed opposite to each other, with a shield plate interconnecting the first gas generating plate and the second gas generating plate to form an accommodation space, and being disposed opposite to the lateral opening and adjacent the second casing; wherein, the first gas generating plate, the second gas generating plate and the shield plate are all made of gas generating material;

a movable contactor and a stationary contactor, installed inside the internal installation space, with the stationary contactor being disposed outside the accommodation space, and the disconnecting portion between the movable contactor and the stationary contactor being located inside the accommodation space and close to the shield plate;

a plurality of arc extinguishing grid-plates, installed at an upper part inside the arc extinguishing chamber), having lower slots which are open towards the accommodation space and have a size that gradually decreases along a direction from the second casing to the first casing.

Preferably, the first casing has a first extension plate disposed against the first gas generating plate and a second extension plate disposed against the second gas generating plate, the first extension plate and the second extension plate are arranged to extend into the arc extinguishing chamber, so as to form a spacing communicated with the accommodation space and disposed opposite to the arc extinguishing grid-plates.

Preferably, the first gas generating plate and the second gas generating plate are disposed parallel to each other, a plurality of opposing protrusion plates are formed on inner side walls of the first gas generating plate and the second gas generating plate, each two neighboring protrusion plates have a groove formed therebetween, and the extension length of the protrusion plates gradually increases along a direction away from the arc extinguishing grid-plates.

Preferably, the first extension plate and the second extension plate are disposed to be slant, so as to allow the spacing to have a larger upper opening and a smaller lower opening.

Preferably, the lower slots have a circular arc shape.

Preferably, the arc extinguishing chamber comprises a first partition plate and a second partition plate installed inside the internal installation space, the first partition plate and the second partition plate are disposed opposite to each other, so as to form a space for installing the gas generating hood and the arc extinguishing grid-plates.

Preferably, the first gas generating plate is disposed parallel to the first partition plate, the second gas generating plate is disposed parallel to the second partition plate; opposing side walls of the arc extinguishing grid-plates are respectively fixed on the first partition plate and the second partition plate and are respectively disposed between the first gas generating plate and first partition plate and between the second gas generating plate and the second partition plate.

Preferably, the arc extinguishing structure further comprises a labyrinth arc extinguishing structure installed inside the internal installation space, the labyrinth arc extinguishing structure has a labyrinth path with one open end facing the arc extinguishing grid-plates for receiving unextinguished electrical arc and the other open end communicated with atmosphere.

Preferably, a sealing space is formed by the labyrinth arc extinguishing structure, the first casing and the second casing, said other open end of the labyrinth path is communicated with the sealing space, and an air venting hole communicated with the sealing space is provided in the first casing and/or the second casing.

Preferably, the labyrinth arc extinguishing structure comprises:

two side installation plates disposed opposite to each other;

at least two layers of first slabs, with each layer having a plurality of the first slabs and each of the first slabs having two ends fixed on inner walls of the two side installation plates, wherein, each two neighboring first slabs on the same layer have a first gap formed therebetween, and the first slabs on an upper layer and a lower layer are arranged to align with each other;

at least one layer of first vertical plates, with each layer having a plurality of the first vertical plates and each of the first vertical plates having an upper end and a lower end respectively connected to the first slabs that align with each other;

a second slab, with one end fixed on the first vertical plate and the other end extending towards another adjacent first vertical plate, and forming a second gap with another adjacent first vertical plate, wherein, the second slab is arranged to shelter an upper first gap from a lower first gap arranged opposite to the upper first gap, the labyrinth path is formed by a plurality of the first gaps and a plurality of the second gaps.

The arc extinguishing structure for direct current circuit breaker provided by the present invention has the following advantages:

1. In the arc extinguishing structure for direct current circuit breaker of the present invention, the arc extinguishing chamber is installed on the second casing and has a lateral opening which opens towards the first casing; the gas generating hood is installed at a lower part inside the arc extinguishing chamber and comprises a first gas generating plate and a second gas generating plate that are disposed opposite to each other, with a shield plate interconnecting the two gas generating plates and being disposed opposite to the lateral opening and adjacent the second casing; the movable contactor and the stationary contactor are installed inside an internal installation space, with the disconnecting portion between the movable contactor and the stationary contactor being located inside the accommodation space and close to the shield plate, so that when the movable contactor becomes disconnected from the stationary contactor and an electric arc is produced, the high-temperature electric arc triggers the first and second gas generating plates and the shield plate to generate a lot of gas which pushes the electric arc to move in a direction away from the shield plate, and the gas generating plates on both lateral sides are continuously heated to generate gas during the moving process of the electric arc, so that the electric arc is blown to accelerate obliquely upwards; the plurality of arc extinguishing grid-plates installed at an upper part inside the arc extinguishing chamber have lower slots which are open towards the accommodation space, so as to guide the electric arc to enter the gaps between the arc extinguishing grid-plates, thereby cooling and extinguishing the electric arc; because the lower slots have a size that gradually decreases along a direction from the second casing to the first casing, the electric arc during its moving process is continuously blocked by the arc extinguishing grid-plates with increasingly smaller sizes of lower slots, and as a result, the electric arc cannot come out from the lateral opening of the arc extinguishing chamber, but instead can only enter the spaces between the arc extinguishing grid-plates, so that a majority of the arc extinguishing grid-plates can be utilized to cool the electric arc and thereby extinguish the electric arc as quickly as possible; the shield plate not only can prevent the electric arc from rushing out of the arc extinguishing chamber, but also can form a relatively closed accommodation space with the first and second gas generating plates, which increases the gas pressure after being triggered to generate gas by the high temperature of the electric arc, so that the electric arc can be blown to accelerate. As compared to prior art, the arc extinguishing structure for direct current circuit breaker of the present invention not only can protect the first casing from being impinged upon and cracking, but also can fully utilize a majority of arc extinguishing grid-plates for improving the arc extinguishing effect.

2. In the arc extinguishing structure for direct current circuit breaker of the present invention, the first casing has a first extension plate disposed against the first gas generating plate and a second extension plate disposed against the second gas generating plate, the first extension plate and the second extension plate are arranged to extend into the arc extinguishing chamber, so as to form a spacing communicated with the accommodation space and disposed opposite to the arc extinguishing grid-plates. Because the spacing formed by the first and second extension plates is communicated with the accommodation space, the horizontal range of movement of the electric arc is widened, so as to provide space for further weakening the energy of the electric arc.

3. In the arc extinguishing structure for direct current circuit breaker of the present invention, the plurality of opposing protrusion plates are formed on inner side walls of the first gas generating plate and the second gas generating plate, each two neighboring protrusion plates have a groove formed therebetween, so that when the electric arc is produced and blown by the gas, the protrusion plates and grooves provided on the gas generating plates can increase the contact area between the electric arc and the gas generating plates, which helps to reduce the temperature of the electric arc and also helps to generate more gas to blow the electric arc to move upwards; the extension length of the protrusion plates gradually increases along a direction away from the arc extinguishing grid-plates, which can block the electric arc from moving downwards, so as to prevent the electric arc from rushing downwards out of the arc extinguishing chamber.

4. In the arc extinguishing structure for direct current circuit breaker of the present invention, the first extension plate and the second extension plate are disposed to be slant, so as to allow the spacing to have a larger upper opening and a smaller lower opening, which can cooperate with the gas generating hood to guide the electric arc to move upwards into the arc extinguishing grid-plates and prevent the electric arc from rushing downwards out of the arc extinguishing chamber.

5. The arc extinguishing structure for direct current circuit breaker of the present invention further comprises a labyrinth arc extinguishing structure installed above the arc extinguishing grid-plates, the labyrinth arc extinguishing structure has a labyrinth path with one open end facing the arc extinguishing grid-plates for receiving unextinguished electrical arc and the other open end communicated with atmosphere. The effect of the labyrinth path is to receive the electrical arc that has passed through the arc extinguishing grid-plates and still has not been extinguished, and further cool the unextinguished electrical arc to extinguish it. The labyrinth path not only increase the length of movement of the electric arc, but also exert a blocking force to the movement of the electric arc, so that the electric arc stays within the labyrinth path for a longer time to be more fully cooled, which helps to extinguish the electric arc.

BRIEF DESCRIPTION OF THE DRAWINGS

In order to more clearly describe the technical schemes in the specific embodiments of the present application or in the prior art, hereinafter, the accompanying drawings required to be used for describing the specific embodiments or the prior art will be briefly introduced. Apparently, for a person skilled in the art, without expenditure of creative labor, other drawings can be derived on the basis of these accompanying drawings.

REFERENCE NUMERALS

1—first casing
11—first extension plate
12—second extension plate
13—spacing
14—air venting hole
2—second casing
10—installation space
3—arc extinguishing chamber
30—lateral opening
31—first partition plate
32—second partition plate
4—gas generating hood
40—accommodation space
41—first gas generating plate
411—first extension portion
412—first hook
42—second gas generating plate
421—second extension portion
422—second hook
43—shield plate
431—third extension portion
432—space
44—protrusion plate
45—groove
46—stationary contactor hole
5—movable contactor
51—second extending part
6—stationary contactor
60—stationary contacting point
61—first extending part
62—first connection part
63—third extending part
64—second connection part
65—wiring part
7—arc extinguishing grid-plate
71—lower slot
8—labyrinth arc extinguishing structure
80—sealing space
81—first slab
811—first gap
82—second slab
821—second gap

83—first vertical plate
84—side installation plate
85—labyrinth path
9—protection plate
91—first protection plate
911—first snap-fit opening
912—second snap-fit opening
92—second protection plate

DETAILED DESCRIPTION OF EMBODIMENTS

A clear and complete description of the technical schemes of the present invention is given below, in conjunction with the accompanying drawings. Apparently, the described embodiments are not all of the embodiments of the present invention. All the other embodiments, derived by a person skilled in the art on the basis of the embodiments described in the present invention without expenditure of creative labor, are included in the protection scope of the present application.

It needs to be noted that, in the description of the present invention, terms such as "first," "second," "third" are merely for the purpose of description and are not to be construed as an indication or implication of relative importance thereof. Furthermore, the technical features involved in the various embodiments of the present invention described below can be combined with one another as long as they do not conflict with one another.

Embodiment

Figure 10:
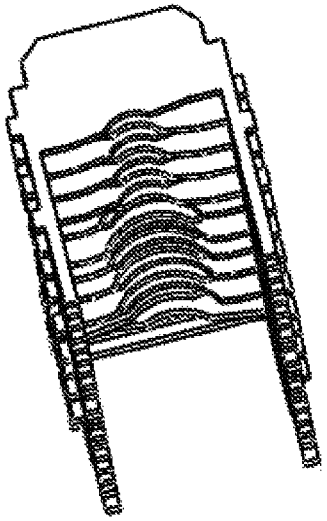
FIG. 10 is a stereogram of the arc extinguishing grid-plates.
Figure 11:
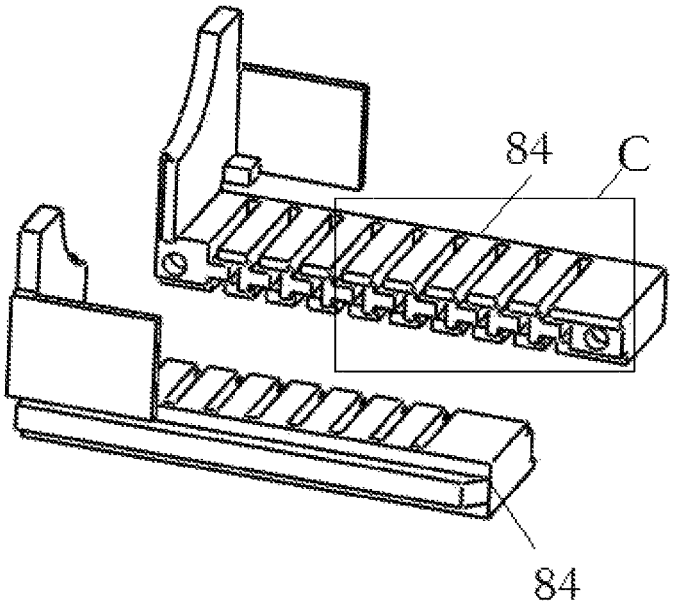
FIG. 11 is an exploded structural view of the labyrinth arc extinguishing structure.
Figure 12:
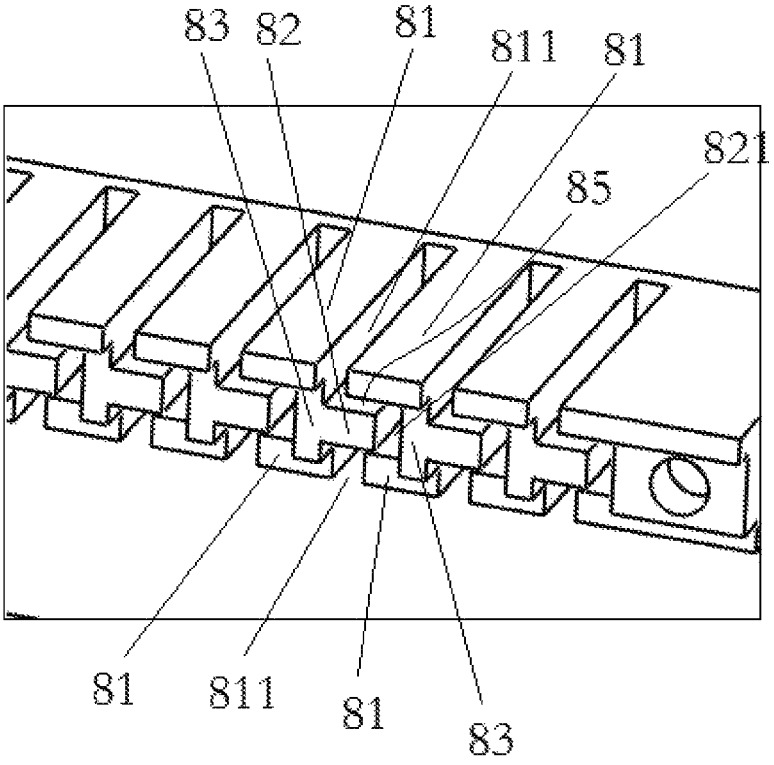
FIG. 12 is an enlarged view of the structure of part C in FIG. 11.

This embodiment provides an arc extinguishing structure for direct current circuit breaker, as shown in FIGS. 1-6 and 9, which comprises a first casing 1; a second casing 2 disposed opposite to the first casing 1 and detachably connected to the first casing 1, for forming an internal installation space 10; an arc extinguishing chamber 3 installed on the second casing 2 and disposed inside the internal installation space 10, with an upper opening, a lower opening and a lateral opening 30 which opens towards the first casing 1; a gas generating hood 4 installed at a lower part inside the arc extinguishing chamber 3, comprising a first gas generating plate 41 and a second gas generating plate 42 that are disposed opposite to each other, with a shield plate 43 interconnecting the first gas generating plate 41 and the second gas generating plate 42 to form an accommodation space 40 and being disposed opposite to the lateral opening 30 and adjacent the second casing 2; wherein, the first gas generating plate 41, the second gas generating plate 42 and the shield plate 43 are all made of gas generating material; a movable contactor 5 and a stationary contactor 6 installed inside the internal installation space 10, with the stationary contactor 6 being disposed outside the accommodation space 40, and the disconnecting portion between the movable contactor 5 and the stationary contactor 6 being located inside the accommodation space 40 and close to the shield plate 43; a plurality of arc extinguishing grid-plates 7 installed at an upper part inside the arc extinguishing chamber 3, having lower slots 71 which are open towards the accommodation space 40 and have a size that gradually decreases along a direction from the second casing 2 to the first casing 1 (as shown in FIG. 10).

When the movable contactor 5 becomes disconnected from the stationary contactor 6 and an electric arc is produced, the high-temperature electric arc triggers the first gas generating plate 41, the second gas generating plate 42 and the shield plate 43 to generate a lot of gas which pushes the electric arc to move in a direction away from the shield plate 43, and the gas generating plates 41, 42 on both lateral sides are continuously heated to generate gas during the moving process of the electric arc, so that the electric arc is blown to accelerate obliquely upwards. The plurality of arc extinguishing grid-plates 7 installed at an upper part inside the arc extinguishing chamber 3 have lower slots 71 which are open towards the accommodation space 40, so as to guide the electric arc to enter the gaps between the arc extinguishing grid-plates 7, thereby cooling and extinguishing the electric arc. Because the lower slots 71 have a size that gradually decreases along a direction from the second casing 2 to the first casing 1, the electric arc during its moving process is continuously blocked by the arc extinguishing grid-plates 7 with increasingly smaller sizes of lower slots 71, and as a result, the electric arc cannot come out from the lateral opening 30 of the arc extinguishing chamber 3, but instead can only enter the spaces between the arc extinguishing grid-plates 7, so that a majority of the arc extinguishing grid-plates 7 can be utilized to cool the electric arc and thereby extinguish the electric arc as quickly as possible. The shield plate 43 not only can prevent the electric arc from rushing out of the arc extinguishing chamber 3, but also can form a relatively closed accommodation space 40 with the first gas generating plate 41 and the second gas generating plate 42, which increases the gas pressure after being triggered to generate gas by the high temperature of the electric arc, so that the electric arc can be blown to accelerate. As compared to prior art, the arc extinguishing structure for direct current circuit breaker of the present invention not only can protect the first casing 1 from being impinged upon and cracking, but also can fully utilize a majority of arc extinguishing grid-plates 7 for improving the arc extinguishing effect.

Figure 1:
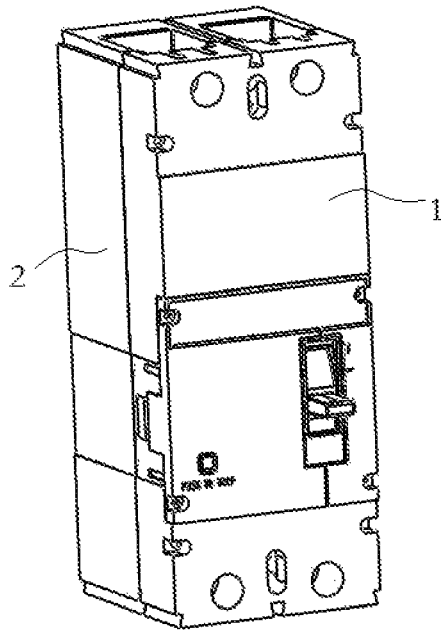
FIG. 1 is an overall structural schematic diagram of the arc extinguishing structure for direct current circuit breaker in the embodiment of the present invention.
Figure 2:
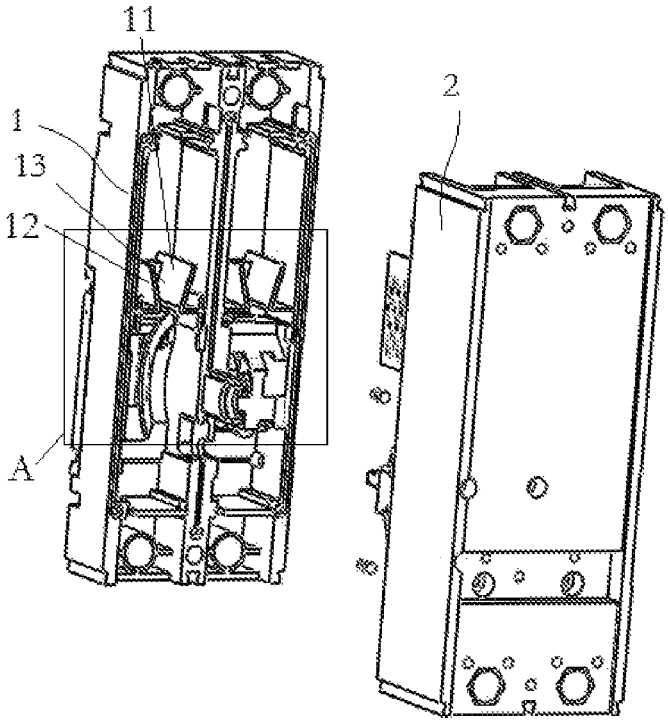
FIG. 2 is a view showing the relative positions of the first casing and the arc extinguishing structure in FIG. 1.
Figure 3:
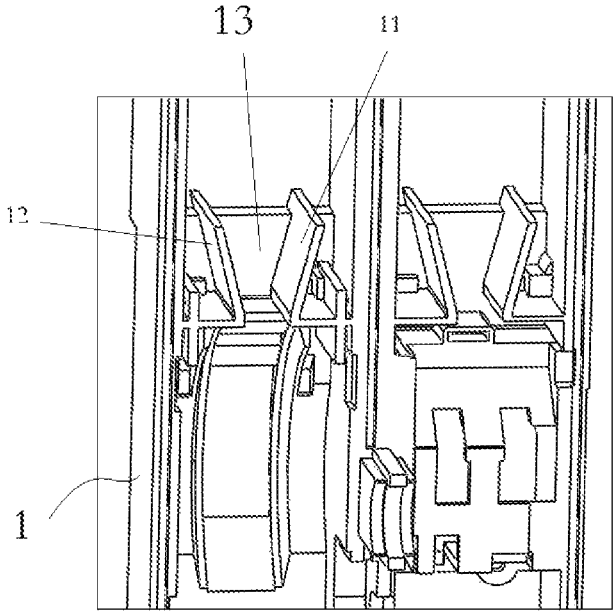
FIG. 3 is an enlarged view of the structure of part A in FIG. 2.

As shown in FIGS. 2-3, the first casing 1 has a first extension plate 11 disposed against the first gas generating plate 41 and a second extension plate 12 disposed against the second gas generating plate 42, the first extension plate 11 and the second extension plate 12 are arranged to extend into the arc extinguishing chamber 3, so as to form a spacing 13 communicated with the accommodation space 40 and disposed opposite to the arc extinguishing grid-plates 7. Because the spacing 13 formed by the first extension plate 11 and the second extension plate 12 is communicated with the accommodation space 40, the horizontal range of movement of the electric arc is widened, so as to provide space for further weakening the energy of the electric arc.

Figure 6:
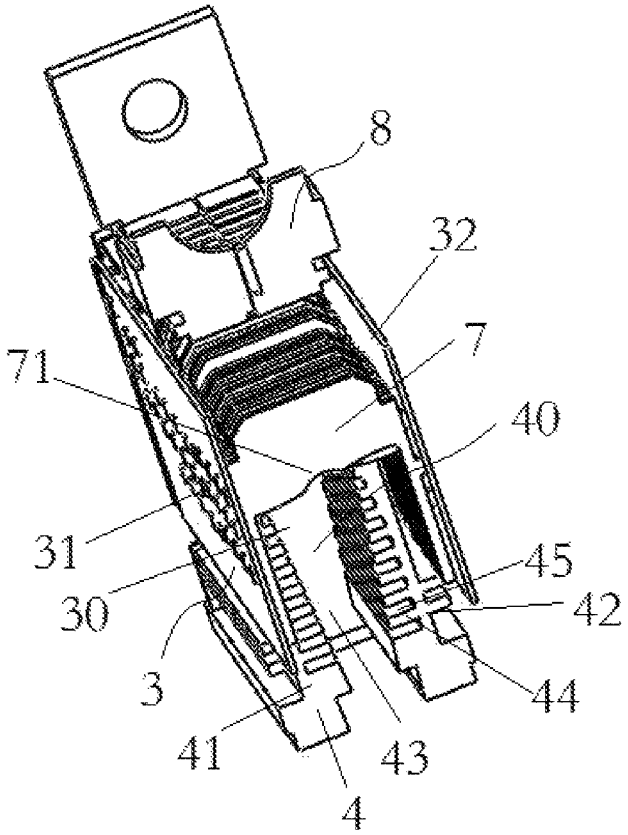
FIG. 6 is an assembled installation view of the arc extinguishing chamber, the arc extinguishing grid-plates, the gas generating hood and the stationary contactor.

As shown in FIG. 6, the first gas generating plate 41 and the second gas generating plate 42 are disposed parallel to each other, a plurality of opposing protrusion plates 44 are formed on inner side walls of the first gas generating plate 41 and the second gas generating plate 42, each two neighboring protrusion plates 44 have a groove 45 formed therebetween, and the extension length of the protrusion plates 44 gradually increases along a direction away from the arc extinguishing grid-plates 7. When the electric arc is produced and blown by the gas, the protrusion plates 44 and grooves 45 provided on the gas generating plates 41, 42 can increase the contact area between the electric arc and the gas generating plates 41, 42, which helps to reduce the temperature of the electric arc and also helps to generate more gas to blow the electric arc to move upwards. The extension length of the protrusion plates 44 is configured to gradually increase along a direction away from the arc extinguishing grid-plates 7, so that the electric arc is blocked from moving downwards and thus prevented from rushing downwards out of the arc extinguishing chamber 3.

The first extension plate 11 and the second extension plate 12 are disposed to be slant, so as to allow the spacing 13 to have a larger upper opening and a smaller lower opening. The benefit of such configuration is that, the spacing 13 can cooperate with the gas generating hood 4 to guide the electric arc to move upwards into the arc extinguishing grid-plates 7 and prevent the electric arc from rushing downwards out of the arc extinguishing chamber 3.

The lower slots 71 have a circular arc shape. The circular arc shaped slots can better allow the electric arc to enter the gaps between the arc extinguishing grid-plates 7.

Figure 7:
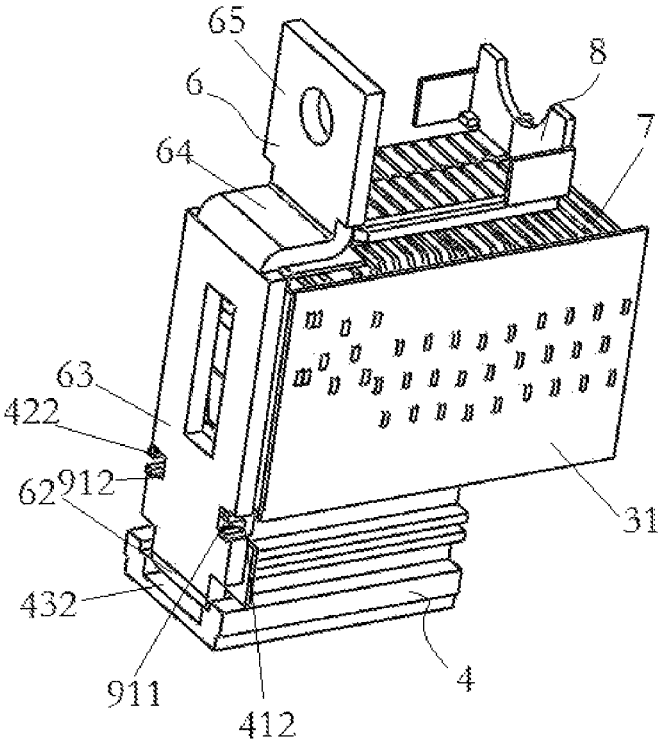
FIG. 7 is another view of FIG. 6.

As shown in FIGS. 6-7, the arc extinguishing chamber 3 comprises a first partition plate 31 and a second partition plate 32 installed inside the internal installation space 10, the first partition plate 31 and the second partition plate 32 are disposed opposite to each other, so as to form a space for installing the gas generating hood 4 and the arc extinguishing grid-plates 7.

The first gas generating plate 41 is disposed parallel to the first partition plate 31, the second gas generating plate 42 is disposed parallel to the second partition plate 32; opposing side walls of the arc extinguishing grid-plates 7 are respectively fixed on the first partition plate 31 and the second partition plate 32 and are respectively disposed between the first gas generating plate 41 and first partition plate 31 and between the second gas generating plate 42 and the second partition plate 32.

As shown in FIGS. 6, 7, 11, 12, the arc extinguishing structure further comprises a labyrinth arc extinguishing structure 8 (the labyrinth arc extinguishing structure in this embodiment is formed by two parts butt-joined together, but may also be provided as a whole piece), the arc extinguishing structure 8 is installed inside the internal installation space 10 and has a labyrinth path 85 with one open end facing the arc extinguishing grid-plates 7 for receiving unextinguished electrical arc and the other open end communicated with atmosphere. The effect of the labyrinth path 85 is to receive the electrical arc that has passed through the arc extinguishing grid-plates 7 and still has not been extinguished, and further cool the unextinguished electrical arc to extinguish it. The labyrinth path 85 not only increase the length of movement of the electric arc, but also exert a blocking force to the movement of the electric arc, so that the electric arc stays within the labyrinth path 85 for a longer time to be more fully cooled, which helps to extinguish the electric arc.

Figure 4:
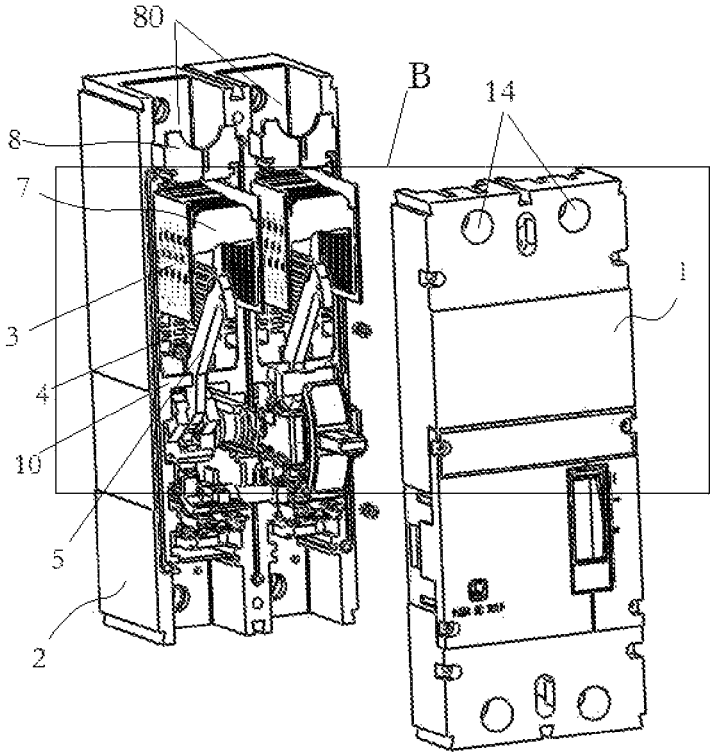
FIG. 4 is a view showing the relative positions of the second casing and the arc extinguishing structure in FIG. 1.
Figure 5:
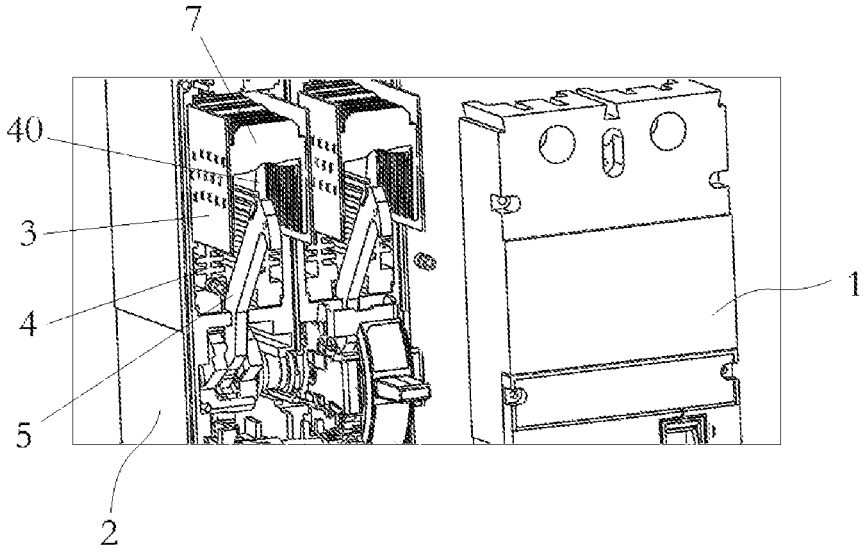
FIG. 5 is an enlarged view of the structure of part B in FIG. 4.

As shown in FIG. 4, a sealing space 80 is formed by the labyrinth arc extinguishing structure 8 together with the first casing 1 and the second casing 2, said other open end of the labyrinth path 85 is communicated with the sealing space 80, and an air venting hole 14 communicated with the sealing space 80 is provided in the first casing 1 and/or the second casing 2.

Specifically, the labyrinth arc extinguishing structure 8 comprises two side installation plates 84 disposed opposite to each other; at least two layers of first slabs 81, with each layer having a plurality of the first slabs 81 and each of the first slabs 81 having two ends fixed on inner walls of the two side installation plates 84, wherein, each two neighboring first slabs 81 on the same layer have a first gap 811 formed therebetween, and the first slabs 81 on an upper layer and a lower layer are arranged to align with each other; at least one layer of first vertical plates 83, with each layer having a plurality of the first vertical plates 83 and each of the first vertical plates 83 having an upper end and a lower end respectively connected to the first slabs 81 on an upper layer and a lower layer that align with each other; a second slab 82, with one end fixed on the first vertical plate 83 and the other end extending towards another adjacent first vertical plate 83, and forming a second gap 821 with another adjacent first vertical plate 83, wherein, the second slab 82 is arranged to shelter an upper first gap 811 from a lower first gap 811 arranged opposite to the upper first gap 811, the labyrinth path 85 is formed by a plurality of the first gaps 811 and a plurality of the second gaps 821.

Figure 13:
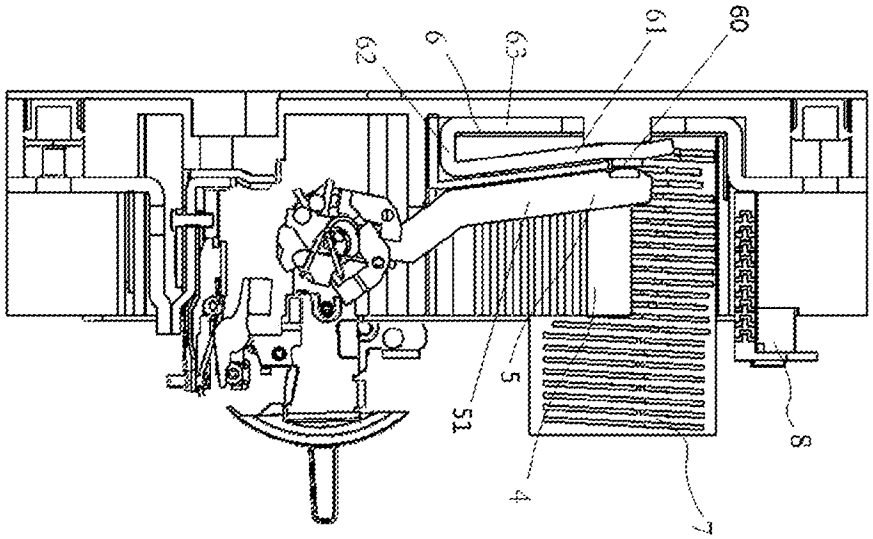
FIG. 13 is a structural view showing the movable contactor and the stationary contactor contacting and connected to each other.

As shown in FIG. 13, the stationary contactor 6 has a first extending part 61, and the movable contactor 5 has a second extending part 51. When the movable contactor 5 and the stationary contactor 6 contact with each other and form a connection, the first extending part 61 is oriented to be substantially parallel to the second extending part 51, so the electrical currents therein have opposite directions after being energized. After energization, the magnetic fields generated by the first extending part 61 and the second extending part 51 at a location between the first extending part 61 and the second extending part 51 have the same direction. As a result, when disconnecting the movable contactor 5 from the stationary contactor 6, these magnetic fields can drive the movable contactor 5 to move more quickly away from the stationary contactor 6, which makes it easy to disconnect the movable and stationary contactors.

Figure 8:
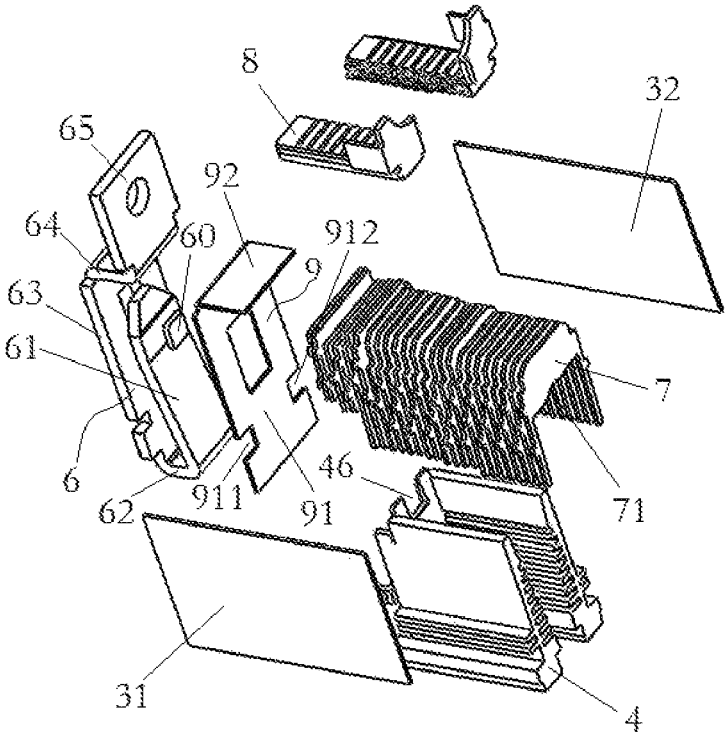
FIG. 8 is an exploded structural schematic diagram of FIG. 6.
Figure 9:
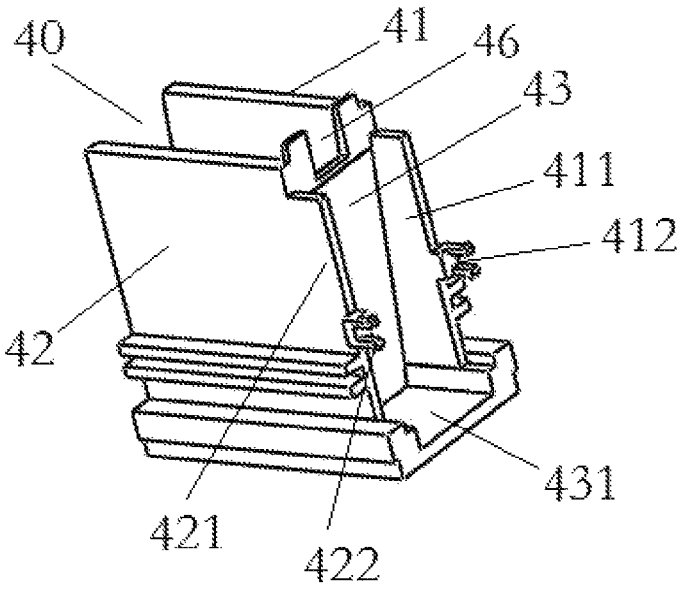
FIG. 9 is a stereogram of the gas generating hood.

As shown in FIGS. 6-8, the first extending part 61 is located outside the accommodation space 40, and is basically parallel to the shield plate 43; the first extending part 61 has a stationary contacting point 60 thereon, and a stationary contactor hole 46 is opened in the shield plate 43 and opposite to the stationary contacting point 60, so that a movable contacting point of the movable contactor 5 inside the accommodation space 40 is allowed to contact and be connected with the stationary contacting point 60 through this stationary contactor hole 46. In such configuration, the disconnecting portion is arranged between the movable contactor 5 and the stationary contactor 6 to be as close as possible to the shield plate 43, so that the electric arc generated by disconnecting the movable and stationary contactors 5, 6 can simultaneously affect the two gas generating plates 41, 42 and the shield plate 43, thereby quickly generating a lot of gas to push the electric arc to move fast.

The stationary contactor 6 comprises the first extending part 61, a third extending part 63 disposed opposite to the first extending part 61, a first connection part 62 interconnecting a bottom end of the first extending part 61 and a bottom end of the third extending part 63, a second connection part 64 connected to a top end of the third extending part 63 and extending horizontally towards the first extending part 61, and a wiring part 65 connected to the second connection part 64. Such configuration arranges the first extending part 61 to be basically parallel to the shield plate 43, so as to conveniently allow the first extending part 61 to be parallel to the second extending part 51, for realizing easy disconnecting of the movable and stationary contactors 5, 6. The configuration of the first connection part 62, the third extending part 63, the second connection part 64 and the wiring part 65 can save space, make the device more compact, and reasonably arrange the wiring positions.

The arc extinguishing structure also comprises a protection plate 9, which comprises a first protection plate 91 disposed between the first extending part 61 and the third extending part 63, as well as a second protection plate 92 connected to the first protection plate 91 and disposed between the second connection part 64 and the arc extinguishing grid-plates 7. The first protection plate 91 can protect the first extending part 61 and make sure the first extending part 61 is only connected to the third extending part 63 through the first connection part 62, thereby making sure that the electrical current direction on the first extending part 61 is opposite to the electrical current direction on the second extending part 51. The second protection plate 92 can prevent the electric arc from darting out from the gaps of the arc extinguishing grid-plates 7 and contacting the stationary contactor 6, thereby ensuring the safety.

The protection plate 9 is fixed on the gas generating hood 4 through a connection structure. The first gas generating plate 41 has a first extension portion 411 extending outwards from the shield plate 43, the second gas generating plate 42 has a second extension portion 421 extending outwards from the shield plate 43, and a portion of the gas generating hood 4 adjacent the shield plate 43 is a closed portion and has a third extension portion 431 extending outwards from the shield plate 43. The first extension portion 411 has a first hook 412, the second extension portion 421 has a second hook 422. The first protection plate 91 has a first snap-fit opening 911 for engaging with the first hook 412 and a second snap-fit opening 912 for engaging with the second hook 422. A space 432 is formed between the first protection plate 91 and the third extension portion 431 for accommodating the first connection part 62.

Several arc extinguishing grid-plates 7 opposite to the second protection plate 92 are provided with lower slots 71 having a size that gradually decreases along a direction towards the stationary contactor 6, and the last one of the arc extinguishing grid-plates 7 is not provided with a lower slot 71. Such structural design can block the electric arc from entering the arc extinguishing grid-plates 7 beneath the second protection plate 92, so as to prevent the electric arc from darting out from this location and contacting the stationary contactor 6, thereby ensuring the safety.

Apparently, the aforementioned embodiments are merely examples illustrated for clearly describing the present application, rather than limiting the implementation ways thereof. For a person skilled in the art, various changes and modifications in other different forms can be made on the basis of the aforementioned description. It is unnecessary and impossible to exhaustively list all the implementation ways herein. However, any obvious changes or modifications derived from the aforementioned description are intended to be embraced within the protection scope of the present application.

The invention claimed is:

1. An arc extinguishing structure for direct current circuit breaker, characterized in comprising:

a first casing (1);

a second casing (2), disposed opposite to the first casing (1) and detachably connected to the first casing (1), for forming an internal installation space (10);

an arc extinguishing chamber (3), installed on the second casing (2) and disposed inside the internal installation space (10), with an upper opening, a lower opening and a lateral opening (30) which opens towards the first casing (1);

a gas generating hood (4), installed at a lower part inside the arc extinguishing chamber (3), comprising a first gas generating plate (41) and a second gas generating plate (42) that are disposed opposite to each other, with a shield plate (43) interconnecting the first gas generating plate (41) and the second gas generating plate (42) to form an accommodation space (40), and being disposed opposite to the lateral opening (30) and adjacent the second casing (2); wherein, the first gas generating plate (41), the second gas generating plate (42) and the shield plate (43) are all made of gas generating material;

a movable contactor and a stationary contactor (5, 6), installed inside the internal installation space (10), with the stationary contactor (6) being disposed outside the accommodation space (40), and a disconnecting portion between the movable contactor and the stationary contactor (5, 6) being located inside the accommodation space (40) and close to the shield plate (43);

a plurality of arc extinguishing grid-plates (7), installed at an upper part inside the arc extinguishing chamber (3), having lower slots (71) which are open towards the accommodation space (40) and have a size that gradually decreases along a direction from the second casing (2) to the first casing (1);

wherein the first casing (1) has a first extension plate (11) disposed against the first gas generating plate (41) and a second extension plate (12) disposed against the second gas generating plate (42), the first extension plate (11) and the second extension plate (12) are arranged to extend into the arc extinguishing chamber (3) so as to form a spacing (13) communicated with the accommodation space (40) and disposed opposite to the arc extinguishing grid-plates (7).

2. The arc extinguishing structure for direct current circuit breaker according to claim 1, characterized in that, the first gas generating plate (41) and the second gas generating plate (42) are disposed parallel to each other, a plurality of opposing protrusion plates (44) are formed on inner side walls of the first gas generating plate (41) and the second gas generating plate (42), each two neighboring protrusion plates (44) have a groove (45) formed therebetween, and an extension length of the protrusion plates (44) gradually increases along a direction away from the arc extinguishing grid-plates (7).

3. The arc extinguishing structure for direct current circuit breaker according to claim 1, characterized in that, the first extension plate (11) and the second extension plate (12) are disposed to be slant, so as to allow the spacing (13) to have a larger upper opening and a smaller lower opening.

4. The arc extinguishing structure for direct current circuit breaker according to claim 1, characterized in that, the lower slots (71) have a circular arc shape.

5. The arc extinguishing structure for direct current circuit breaker according to claim 1, characterized in that, the arc extinguishing chamber (3) comprises a first partition plate (31) and a second partition plate (32) installed inside the internal installation space (10), the first partition plate (31) and the second partition plate (32) are disposed opposite to each other, so as to form a space for installing the gas generating hood (4) and the arc extinguishing grid-plates (7).

6. The arc extinguishing structure for direct current circuit breaker according to claim 5, characterized in that, the first gas generating plate (41) is disposed parallel to the first partition plate (31), the second gas generating plate (42) is disposed parallel to the second partition plate (32); opposing side walls of the arc extinguishing grid-plates (7) are respectively fixed on the first partition plate (31) and the second partition plate (32) and are respectively disposed between the first gas generating plate (41) and first partition plate (31) and between the second gas generating plate (42) and the second partition plate (32).

7. The arc extinguishing structure for direct current circuit breaker according to claim 1, characterized in further comprising a labyrinth arc extinguishing structure (8) installed inside the internal installation space (10), the labyrinth arc extinguishing structure (8) has a labyrinth path (85) with one open end facing the arc extinguishing grid-plates (7) for receiving unextinguished electrical arc and the other open end communicated with atmosphere.

8. The arc extinguishing structure for direct current circuit breaker according to claim 7, characterized in that, a sealing space (80) is formed by the labyrinth arc extinguishing structure (8), the first casing (1) and the second casing (2), said other open end of the labyrinth path (85) is communicated with the sealing space (80), and an air venting hole (14) communicated with the sealing space (80) is provided in the first casing (1) and/or the second casing (2).

9. The arc extinguishing structure for direct current circuit breaker according to claim 8, characterized in that, the labyrinth arc extinguishing structure (8) comprises:

two side installation plates (84) disposed opposite to each other;

at least two layers of first slabs (81), with each layer having a plurality of the first slabs (81) and each of the first slabs (81) having two ends fixed on inner walls of the two side installation plates (84), wherein, each two neighboring first slabs (81) on a same layer have a first gap (811) formed therebetween, and the first slabs (81) on an upper layer and a lower layer are arranged to align with each other;

at least one layer of first vertical plates (83), with each layer having a plurality of the first vertical plates (83) and each of the first vertical plates (83) having an upper end and a lower end respectively connected to the first slabs (81) that align with each other;

a second slab (82), with one end fixed on the first vertical plate (83) and the other end extending towards another adjacent first vertical plate (83), and forming a second gap (821) with another adjacent first vertical plate (83), wherein, the second slab (82) is arranged to shelter an upper first gap (811) from a lower first gap (811) arranged opposite to the upper first gap (811), the labyrinth path (85) is formed by a plurality of the first gaps (811) and a plurality of the second gaps (821).

* * * * *